US006048400A

United States Patent [19]

Ohtani

[11] Patent Number: 6,048,400

[45] Date of Patent: Apr. 11, 2000

[54] SUBSTRATE PROCESSING APPARATUS

[75] Inventor: Masami Ohtani, Kyoto, Japan

[73] Assignee: Dainippon Screen Mfg. Co., Ltd., Japan

[21] Appl. No.: 08/912,699

[22] Filed: Aug. 18, 1997

[30] Foreign Application Priority Data

Aug. 20, 1996 [JP] Japan ..... 8-218401

[51] Int. Cl.[7] ..... B05C 5/00

[52] U.S. Cl. ..... 118/688; 118/712; 118/52; 118/319; 118/320

[58] Field of Search ..... 118/52, 600, 319, 118/320, 688, 689, 712; 239/71; 366/338, 339, 195

[56] References Cited

U.S. PATENT DOCUMENTS 4,451,507 5/1984 Beltz et al. ..... 118/52

4,753,536 6/1988 Spehar et al. ..... 366/339

5,464,283 11/1995 Davis ..... 239/71

*Primary Examiner*—Laura Edwards

*Attorney, Agent, or Firm*—Ostrolenk, Faber, Gerb & Soffen, LLP

[57] ABSTRACT

A substrate processing apparatus has a simple structure in which the number of nozzles is reduced. In a mixer part, photoresist which is supplied from a photoresist supply through a lower arm portion of the nozzle arm is mixed with solvent which is supplied from a solvent supply through a pipe. Following this mixing, the photoresist and the solvent flow through an upper arm portion and are ejected from a nozzle toward a substrate. In the nozzle arm, a viscometer is disposed to the upper arm portion. The viscometer measures a viscosity of photoresist solution which is obtained by mixing in the mixer part. In accordance with the measurement from the viscometer, the quantity of solvent supplied from the solvent supply is controlled, thereby obtaining a photoresist solution having a desired viscosity.

9 Claims, 4 Drawing Sheets

SUBSTRATE PROCESSING APPARATUS

BACKGROUND OF THE INVENTION

1. Field of the Invention

The present invention relates to a substrate processing apparatus which coats a thin plate-like substrate (hereinafter "substrate"), such as a semiconductor substrate and a glass substrate of liquid crystal, with a chemical such as a resist.

2. Description of the Prior Art

In general, a substrate such as described above is coated with a resist which is photosensitive to light and which is used to form a pattern. It is necessary to change the film thickness of the applied coating resist in accordance with a characteristic which the substrate is required to have.

In a conventional approach, during coating of a substrate with a resist, the resist is injected through a nozzle while rotating the substrate so that the substrate is coated uniformly with a resist film. In order to change the film thickness of the resist according to this approach, methods such as (1) changing the number of rotations of the substrate and (2) using a resist having a different viscosity are used. More particularly, when the number of rotations of the substrate is changed, the greater number of times the substrate is rotated, the thinner the resist film becomes, whereas the smaller number of times the substrate is rotated, the thicker the resist film becomes. Meanwhile, a resist having a different viscosity is used, the greater the viscosity of the resist, the thicker the resist film becomes, whereas the smaller the viscosity of the resist, the thinner the resist film becomes.

In, recent years substrates have become larger and larger in diameter, with some substrates as large as 300 mm or larger in diameter being manufactured. With respect to a substrate having such a large diameter, the number of rotations the substrate can be rotated in order to uniformly spread resist is limited, and therefore, to change the number of rotations the substrate is rotated in order to change the film thickness of the resist is difficult. Hence, in order to change the film thickness of the resist for the substrate which has such a large diameter, a method using a resist having a different viscosity is used.

FIG. 5 is a conceptual diagram of a conventional nozzle structure for the case where a resist having a different viscosity is used. As shown in FIG. 5, a plurality of nozzles are disposed for resists of different types. During coating with resist A, for example a low viscosity resist nozzle A-1 is used to form a thin resist film, a high viscosity resist nozzle A-2 is used to form a thick resist film, and a middle viscosity resist nozzle A-3 is used to form a medium thick resist film. In a similar manner, with respect to resist B and resist C as well, there are a plurality of nozzles disposed for necessary thicknesses. Thus, a number of nozzles are needed in a substrate processing apparatus as a whole, and hence, a number of pipelines are needed, which complicates the structure of the apparatus.

SUMMARY OF THE INVENTION

The present invention is directed to an apparatus for coating a substrate with a chemical solution.

According to the present invention, the apparatus comprises: a) chemical feeding means for feeding a chemical; b) solvent feeding means for feeding solvent to dilute the chemical; c) mixer means for mixing the chemical and the solvent to obtain the chemical solution; and d) nozzle means for injecting the chemical solution on a major surface of the substrate.

Since it is possible to obtain a chemical solution having different mixing ratios from one nozzle, only one nozzle may be disposed for chemicals of each type. This reduces the number of nozzles in a substrate processing apparatus as a whole, and hence, simplifies the structure of the apparatus.

In another aspect of the present invention, the apparatus further comprises: e) nozzle arm means for holding the nozzle means while guiding the chemical solution to the nozzle means, and the mixer means is attached to the nozzle arm means.

Only the chemical solution which remains from the mixer means to the nozzle accounts for the quantity of the chemical solution which needs to be drained before and after processing a substrate. Hence, the quantity of wasted chemical solution is less than in a structure where the chemical solution supplied is mixed in advance.

In another aspect of the present invention, the apparatus further comprises: f) measuring means for measuring a mixing ratio of the chemical and the solvent in the chemical solution; and g) means for controlling the solvent feeding means to change a quantity of the solvent to be supplied in accordance with the mixing ratio.

Hence, it is possible to obtain a chemical solution of a necessary mixing ratio in an easy manner.

The present invention is also directed to a method of coating a substrate with a chemical solution, comprising the steps of: a) feeding a chemical; b) feeding a solvent to dilute the chemical; c) mixing the chemical and the solvent to obtain the chemical solution; and d) injecting the chemical solution on a major surface of the substrate.

Accordingly, an object of the present invention is to provide for a substrate processing apparatus having a simple structure in which the number of nozzles is small.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention will be described in detail, with reference to associated drawings. At the outset, terms which will be used in the following description regarding the preferred embodiment will be explained. As hereinafter used, for clarity of terminology, the term "photoresist (chemical)" refers to a liquid which is formed by a resin component and a photosensitive agent or liquid which is obtained by adding a certain solvent in advance to a liquid which is formed by a resin component and a photosensitive agent, whereas the term "photoresist solution (chemical solution)" refers to solution which is diluted by adding a to such a photoresist.

Figure 1:
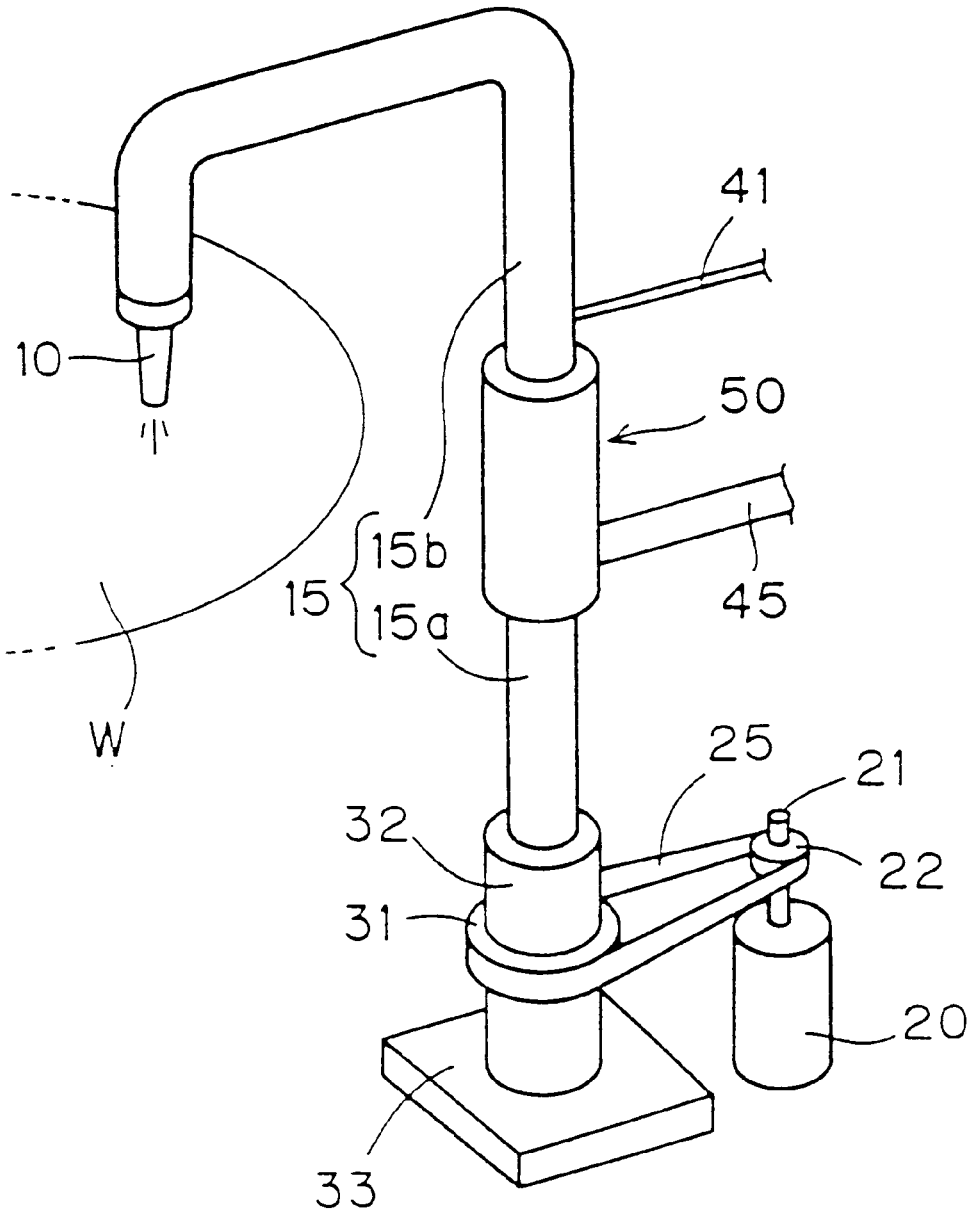
FIG. 1 is a perspective view of a substrate processing apparatus according to the present invention.

FIG. 1 is a perspective view of a substrate processing apparatus according to the present invention. The substrate processing apparatus is an apparatus in which while rotating a substrate W with a rotating drive mechanism not shown, a photoresist solution is injected onto the substrate W, so that a uniform resist film is formed. The substrate processing apparatus comprises a nozzle 10 for injecting the photoresist solution, a nozzle arm 15 for holding the nozzle 10 and guiding the photoresist solution to the nozzle 10, and a motor 20 for rotating the nozzle 10 and the nozzle arm 15.

The motor 20 is fixed to a housing of the main body of the substrate processing apparatus, and a pulley 22 is directly linked to a motor shaft 21 of the motor 20. A bottom edge portion of a lower arm portion 15*a* of the nozzle arm 15 is inserted into an outer cylinder 32, a pulley 31 is disposed to an outer periphery of the outer cylinder 32. Rotation movement of the motor 20 is transmitted to the outer cylinder 32, through the motor shaft 21, the pulley 22, a belt 25 and the pulley 31. Since the outer cylinder 32 is disposed for free rotation to a support pedestal 33 which is fixed to the housing of the main body of the substrate processing apparatus, as the motor 20 rotates, the nozzle arm 15 revolves. As the nozzle arm 15 revolves, the nozzle 10 moves between a standby position for transferring a substrate W and a processing position for applying the resist to a substrate W.

The nozzle arm 15 is a hollow pipe, and the nozzle 10 is disposed to one end of an upper arm portion 15*b* of the nozzle arm 15. On the other hand, the bottom edge portion of the lower arm portion 15*a* is connected to a photoresist supply line not shown, through the support pedestal 33. The photoresist supply line is connected to photoresist supplying means 1 (See FIG. 3 which will be described later). In the nozzle arm 15, between the lower arm portion 15*a* and the upper arm portion 15*b*, a mixer part 50 is disposed for mixing a photoresist and a solvent.

Figure 2:
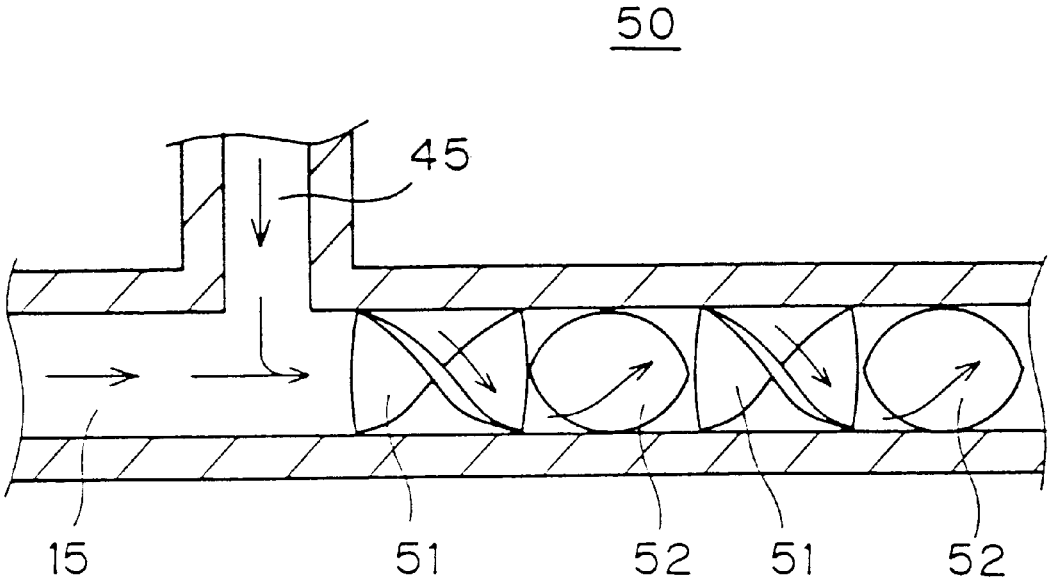
FIG. 2 is a cross sectional view of a mixer part of the substrate processing apparatus of FIG. 1.

FIG. 2 is a cross sectional view of the mixer part 50. In FIG. 2, an arrow of a solid line denotes a flow of fluid. As shown in FIG. 2, a pipe 45 for guiding solvent from the solvent supplying means 2 (See FIG. 3 which will be described later) is connected to the mixer part 50. Further, in the mixer part 50, along a direction in which a fluid flows, such as a photoresist and a solvent, flows, right-hand side elements 51 and left-hand side elements 52 are arranged alternatively. The direction in which the fluid rotates is opposite between the right-hand side elements 51 and the left-hand side elements 52. Fluid which passes through the right-hand and the left-hand side elements, due to reversing of the direction in which the fluid rotates, is sufficiently agitated and mixed. Hence, the photoresist and solvent which flow into the mixer part 50 are sufficiently mixed with each other in the mixer part 50 and thereafter flow in the upper arm portion 15*b* of the nozzle arm 15 as photoresist a solution, before injected from the nozzle 10 a substrate W.

Referring to FIG. 1, a viscometer 41 is disposed to the upper arm portion 15*b* of the nozzle arm 15. The viscosity of the photoresist solution changes in accordance to a mixing ratio by which the photoresist and solvent are mixed, and therefore, the viscometer 41 functions as mixing ratio measuring means for measuring a mixing ratio of the photoresist and the solvent which are contained in the photoresist solution.

Figure 3:
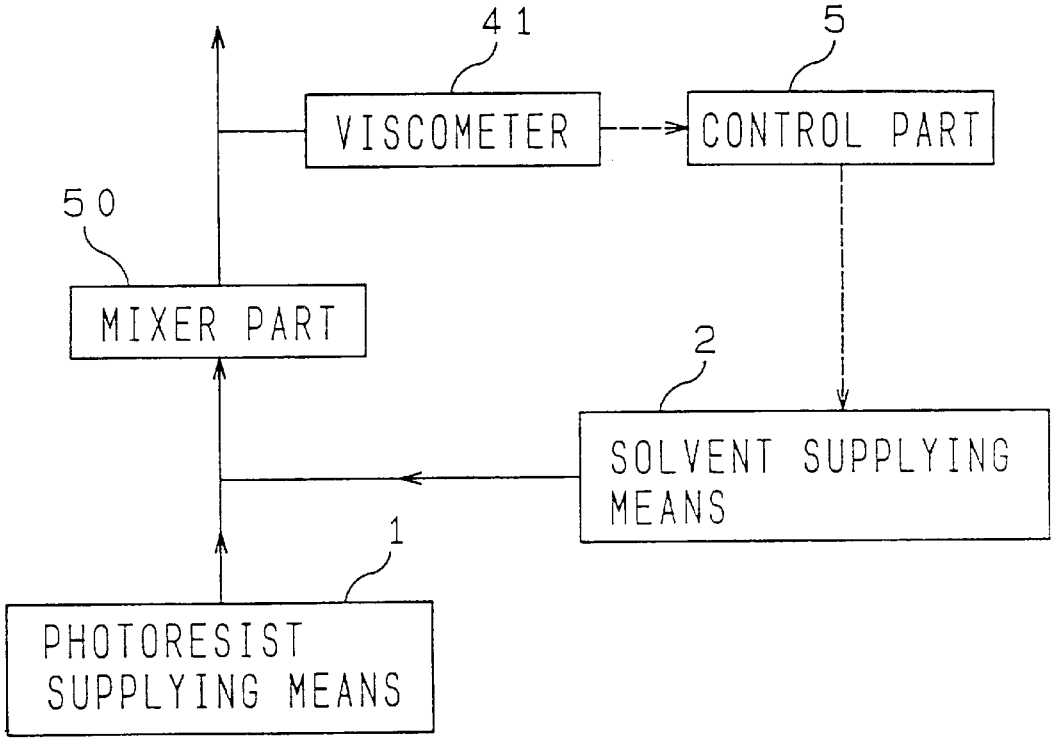
FIG. 3 is a block diagram showing a resist viscosity adjusting mechanism of the substrate processing apparatus of FIG. 1.

Based on the measurement determined by the viscometer 41, a viscosity of the photoresist solution, namely, the mixing ratio of the photoresist and the solvent, is adjusted. FIG. 3 is a block diagram showing a resist viscosity adjusting mechanism of the substrate processing apparatus according to the present invention. In FIG. 3, an arrow of a solid line denotes a flow of fluid such as photoresist and solvent, whereas an arrow of a dotted line denotes transmission of an electric signal.

In the substrate processing apparatus according to the present invention, a constant amount of photoresist is always supplied from the photoresist supplying means 1. The photoresist is mixed by the mixer part 50 with solvent which is supplied from the solvent supplying means 2 and thereafter led into the nozzle 10. The viscosity of the photoresist solution, which is obtained as a result of mixing, is measured by the viscometer 41, and a result of the measurement is transmitted to a control part 5 which is disposed in the substrate processing apparatus.

The control part 5 stores in advance a film thickness of resist which is to be applied to a substrate W which needs to be processed and a table of correspondence which correlates a film thickness of resist with a viscosity of photoresist solution at a certain number of rotations. The viscosity of the photoresist solution which is needed to achieve a resist film thickness on substrate W is compared with the viscosity of the photoresist solution which is measured by the viscometer 41. In accordance with the comparison, the control part 5 provides the solvent supplying means 2 with an instruction, so that a solvent supply quantity of from the solvent supplying means 2 is automatically adjusted.

That is, when the viscosity of the photoresist solution measured by the viscometer 41 is higher than the necessary viscosity of the photoresist solution needed to achieve the resist film thickness an automatic adjustment is executed to increase the solvent supply quantity. Conversely, when the viscosity of the photoresist solution is lower than the necessary viscosity needed to achieve the resist film thickness an, an automatic adjustment is executed to decrease the solvent supply quantity. More specifically, the number of rotations at which a supply pump within the solvent supplying means 2 rotates is changed, whereby the solvent supply quantity is automatically adjusted. The means for automatically adjusting the solvent supply quantity is not limited to this melted. Alternatively, the flow rate of a supply valve may be changed.

It is possible to adjust the viscosity of the photoresist solution in the manner described above. Hence, as far as resist films of the same type are desired, even if film thicknesses to be achieved vary, it is possible to obtain desired resist film thicknesses by means of only one nozzle 10.

Figure 4:
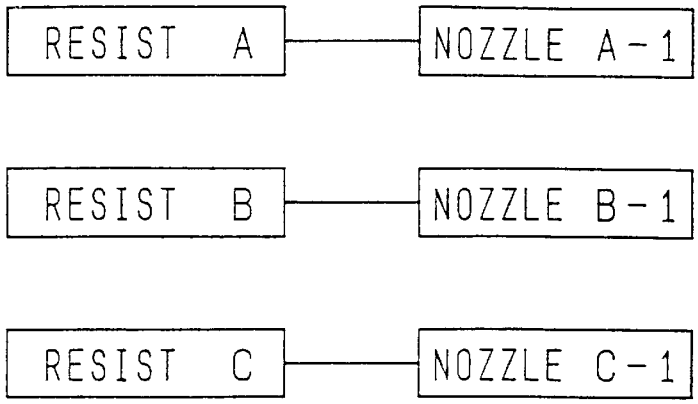
FIG. 4 is a block diagram of a nozzle structure of the substrate processing apparatus of FIG. 1.
Figure 5:
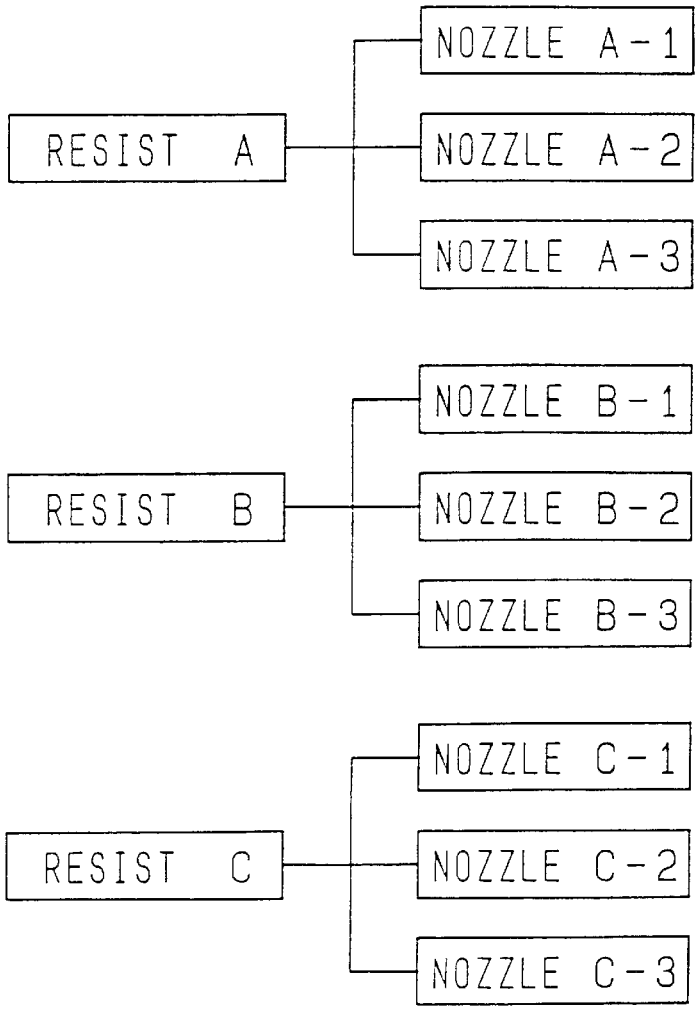
FIG. 5 PRIOR ART
FIG. 5 is a diagram of a conventional nozzle structure for a case where resist having a different viscosity is used.

FIG. 4 is a block diagram of a nozzle structure of the substrate processing apparatus according to the present invention. As shown in FIG. 4, one nozzle is disposed to correspond to each resist type. In other words, when resist A is to be applied, only with a nozzle A-1, a viscosity of solution of the resist A is variably adjusted, thereby obtaining an optional film thickness. In a similar manner, with respect to resist B and resist C as well, only with one nozzle B-1 and one nozzle C-1, respectively, an optional film thickness is achieved. This reduces the number of the nozzles in the substrate processing apparatus as a whole, and hence, accordingly reduces the number of necessary pipelines, which in turn simplifies the structure of the apparatus.

Further, since the mixer part 50 is disposed between the lower arm portion 15*a* and the upper arm portion 15*b*, only the photoresist solution which remains in the upper arm portion 15*b* accounts for the quantity of the photoresist solution which needs to be drained before and after application of the photoresist. Hence, the quantity of wasted photoresist is lessened than in a structure where the photoresist solution which is mixed in advance is supplied.

Although the foregoing has described the present invention in relation to the preferred embodiment, the present invention is not limited to the preferred embodiment described above. For example, while the preferred embodiment above uses photoresist as a chemical, the chemical may be polyimide, SOG (Spin-on-Glass, i.e., an insulated inorganic film which is disposed between layers in a multi-layer wire structure of an LSI), etc. When SOG is used as the chemical, a concentration meter is used instead of the viscometer 41, in order to measure the mixing ratio.

Further, with respect to the mixer part 50, while the foregoing has described that the right-hand side elements 51 and the left-hand side elements 52 are arranged alternatively so that the photoresist and the solvent are mixed with each other, the structure of the mixer part 50 may be any structure which is capable of mixing the two types of fluid.

Further, while the foregoring has described that the mixer part 50 is disposed between the lower arm portion 15*a* of the nozzle arm 15 and the upper arm portion 15*b* of the nozzle arm 15, the mixer part 50 may be disposed below a bottom edge portion of a lower arm portion 15*a* of the nozzle arm 15.

While the invention has been described in detail, the foregoing description is in all aspects is illustrative and not restrictive. It is understood that numerous other modifications and variations can be devised without departing from the scope of the invention.

I claim:

1. An apparatus for coating a substrate with a chemical solution, comprising:

a) chemical feeding means for feeding a chemical;

b) solvent feeding means for feeding solvent to dilute said chemical;

c) mixer means for mixing said chemical and said solvent to obtain said chemical solution;

d) nozzle means for injecting said chemical solution onto a major surface of said substrate;

e) measuring means for measuring a mixing ratio of said chemical and said solvent in said chemical solution after said mixer means mixes said chemical and said solvent to obtain said chemical solution; and f) controlling means for controlling said solvent feeding means to change a quantity of said solvent to be supplied in accordance with said measured mixing ratio.

2. The apparatus of claim 1, further comprising:

nozzle arm means for holding said nozzle means while guiding said chemical solution to said nozzle means;

and wherein said mixer means is attached to said nozzle arm means.

3. The apparatus of claim 2, further comprising:

driving means for rotating said nozzle arm means.

4. The apparatus of claim 1, wherein said chemical solution is a photoresist solution, and said measuring means measures a viscosity of said photoresist solution.

5. The apparatus of claim 1, wherein said measuring means comprises viscosity measuring means for measuring a viscosity of said chemical solution, and said controlling means increases a quantity of said solvent to be supplied when a viscosity of said chemical solution measured by said viscosity measuring means is higher than a predetermined value and decreases a quantity of said solvent to be supplied when a viscosity of said chemical solution measured means is lower then said predetermined value.

6. An apparatus for coating a substrate with a chemical solution, comprising:

a) a chemical feeding device feeding a chemical;

b) a solvent feeding device feeding solvent to dilute said chemical;

c) a mixer mixing said chemical and said solvent to obtain said chemical solution;

d) a nozzle injecting said chemical solution onto a major surface of said substrate;

e) a measuring device measuring a mixing ratio of said chemical and said solvent in said chemical solution after said mixer mixes said chemical and said solvent to obtain said chemical solution; and f) a controller controlling said solvent feeding means to change a quantity of said solvent to be supplied in accordance with said measured mixing ratio.

7. The apparatus of claim 6, further comprising:

a nozzle arm for holding said nozzle while guiding said chemical solution to said nozzle;

and wherein said mixer is attached to said nozzle arm.

8. The apparatus of claim 7, further comprising:

a driver rotating said nozzle arm.

9. The apparatus of claim 6, wherein said chemical solution is a photoresist solution, and said measuring device measures a viscosity of said photoresist solution.

* * * * *